US008288696B1

(12) United States Patent
Boka et al.

(10) Patent No.: US 8,288,696 B1
(45) Date of Patent: Oct. 16, 2012

(54) INERTIAL BOOST THRUST VECTOR CONTROL INTERCEPTOR GUIDANCE

(75) Inventors: Jeffrey B. Boka, Lumberton, NJ (US); Purusottam Mookerjee, Bridgewater, NJ (US); Naresh R. Patel, Bellmawr, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 1238 days.

(21) Appl. No.: 11/935,687

(22) Filed: Nov. 6, 2007

Related U.S. Application Data

(60) Provisional application No. 60/962,065, filed on Jul. 26, 2007.

(51) Int. Cl.

| | |
|---|---|
| ***F41G 7/30*** | (2006.01) |
| ***F42B 15/01*** | (2006.01) |
| *F41G 7/00* | (2006.01) |
| *F42B 15/00* | (2006.01) |

(52) U.S. Cl. ..... 244/3.11; 244/3.1; 244/3.14; 89/1.11; 342/61; 342/62; 342/175; 342/195

(58) Field of Classification Search ..... 89/1.11; 244/3.1–3.3; 342/61, 62, 175, 195
See application file for complete search history.

(56) References Cited

U.S. PATENT DOCUMENTS

| | | | | | |
|---|---|---|---|---|---|
| 3,883,091 | A | * | 5/1975 | Schaefer | 244/3.13 |
| 4,529,151 | A | * | 7/1985 | Skarman | 244/3.15 |
| 4,568,039 | A | * | 2/1986 | Smith et al. | 244/3.15 |
| 4,925,129 | A | * | 5/1990 | Salkeld et al. | 244/3.11 |
| 5,050,818 | A | * | 9/1991 | Sundermeyer | 244/3.15 |
| 5,340,056 | A | * | 8/1994 | Guelman et al. | 244/3.16 |
| 5,464,174 | A | * | 11/1995 | Laures | 244/3.11 |
| 5,662,291 | A | * | 9/1997 | Sepp et al. | 244/3.13 |
| 5,671,138 | A | * | 9/1997 | Bessacini et al. | 244/3.13 |
| 5,671,140 | A | * | 9/1997 | Bessacini et al. | 244/3.15 |
| 5,828,571 | A | * | 10/1998 | Bessacini et al. | 244/3.15 |
| 5,944,762 | A | * | 8/1999 | Bessacini et al. | 244/3.15 |
| 5,987,362 | A | * | 11/1999 | Bessacini et al. | 244/3.15 |
| 6,209,820 | B1 | * | 4/2001 | Golan et al. | 244/3.15 |
| 6,527,222 | B1 | * | 3/2003 | Redano | 244/3.14 |
| 6,666,401 | B1 | * | 12/2003 | Mardirossian | 244/3.11 |
| 6,739,547 | B2 | * | 5/2004 | Redano | 244/3.14 |
| 6,990,885 | B2 | * | 1/2006 | Boyd | 89/1.11 |
| 7,009,554 | B1 | | 3/2006 | Mookerjee et al. | |
| 7,026,980 | B1 | * | 4/2006 | Mavroudakis et al. | 342/195 |
| 7,137,588 | B2 | * | 11/2006 | Humphrey | 244/3.15 |
| 7,180,443 | B1 | | 2/2007 | Mookerjee et al. | |
| 7,185,844 | B2 | * | 3/2007 | Yanushevsky | 244/3.15 |
| 7,190,304 | B1 | * | 3/2007 | Carlson | 342/62 |
| 7,277,047 | B1 | | 10/2007 | Mookerjee et al. | |
| 7,338,009 | B1 | * | 3/2008 | Bobinchak et al. | 244/3.15 |

(Continued)

*Primary Examiner* — Bernarr Gregory
(74) *Attorney, Agent, or Firm* — Howard IP Law Group, PC

(57) ABSTRACT

A method for engaging a target missile includes sensing the position of the target and of an interceptor missile, and determining time-to-go to intercept and direction of thrust of the interceptor. A one-step intercept solution is determined based on position estimates of the target and the interceptor and is used to iteratively estimate at least two components of a three-dimensional unit thrust vector, and apply updated guidance commands to the interceptor. A system for thrust vector control of an interceptor against a target missile includes a processor for receiving sensed target signals, determining a one-step initial solution to produce time-to-go and current direction of thrust of the interceptor, iteratively estimating at least two components of a three-dimensional unit thrust vector, and producing a guidance vector for application to the interceptor.

20 Claims, 7 Drawing Sheets

U.S. PATENT DOCUMENTS 7,348,918 B2 * 3/2008 Redano ..... 342/62
7,375,679 B1 5/2008 Mookerjee et al.
7,394,047 B1 * 7/2008 Pedersen ..... 244/3.1
7,400,289 B1 * 7/2008 Wolf ..... 342/62
7,411,543 B1 * 8/2008 Boka ..... 342/195
7,422,175 B1 * 9/2008 Bobinchak et al. ..... 244/3.15
7,446,291 B1 * 11/2008 Bock ..... 244/3.1
7,473,876 B1 * 1/2009 Pedersen et al. ..... 244/3.1
7,487,933 B1 * 2/2009 Chen et al. ..... 244/3.15
7,494,089 B2 * 2/2009 Williams et al. ..... 244/3.16
7,494,090 B2 * 2/2009 Leal et al. ..... 244/3.16
7,511,252 B1 * 3/2009 Pedersen et al. ..... 244/3.1
7,513,455 B1 * 4/2009 Mavroudakis et al. ..... 244/3.15
7,626,534 B1 12/2009 Boka et al.
7,652,234 B2 * 1/2010 Shukrun ..... 244/3.15
7,675,012 B1 * 3/2010 Bobinchak et al. ..... 244/3.15
7,719,461 B1 5/2010 Mookerjee et al.
7,791,006 B2 * 9/2010 Hasson et al. ..... 244/3.15
7,947,936 B1 * 5/2011 Bobinchak et al. ..... 244/3.15
2011/0025551 A1 2/2011 Luu et al.

* cited by examiner

Kinematical propagation of an object

Kinematical components of an accelerating object

Acceleration of a rocket motor

Gravity model on a space-borne object for a round earth

INERTIAL BOOST THRUST VECTOR CONTROL INTERCEPTOR GUIDANCE

This application claims priority to provisional application No. 60/962,065 filed Jul. 26, 2007.

This invention was made with Government support under contract number N00024-03-C-6110 awarded by the Department of the Navy. The Government has certain rights in this invention.

FIELD OF THE INVENTION

This invention relates to generation of guidance control commands for an interceptor missile attack on a target missile.

BACKGROUND OF THE INVENTION

Currently used state-of-the-art exoatmospheric antimissile guidance algorithms are generally limited to engagements in which the target missile is ballistic, in that it has no acceleration attributable to a rocket motor. This is true of a system and algorithm known as Burnout Reference Guidance (BRG) currently used for thrust vector control (TVC) of the SM-1 interceptor during exoatmospheric portions of flight. BRG works, in general, by proportional navigation that attempts to null out the line-of-sight rate. Interest has recently been directed toward launching interceptor missiles and intercepting target missiles during the boost phase of target missile flight. Analysis of BRG guidance, even when modified to include target missile acceleration (and renamed "modBRG"), suggests that it may not be optimal against boosting target missiles, in that guidance errors may result in missing of the target. Amended algorithms applied to modBRG have not sufficiently decreased guidance errors.

Improved thrust control guidance control of antimissiles is desired for action against target missiles in both their boost and ballistic states.

SUMMARY OF THE INVENTION

In general, a guidance system according to an aspect of the invention attempts to generate an exact solution to the intercept point of an interceptor missile with a target missile, based on nonlinear iterative algorithms in which approximations are reduced or eliminated. More particularly, a "one-step" or "bootstrap" solution to the intercept point is generated by determining time-to-go to intercept and the direction of the thrust vector of the interceptor missile, and using this one-step solution as the basis or state vector as a starting point for an iterative solution. The iterative solution generates the commands for the interceptor missile.

The logic of one-step initial intercept solution is aided by the following analysis. Let the initial position and velocity at time $t_0$ of a target T, such as a missile, be denoted by $p^T(0)$, $v^T(0)$ respectively. The motion of the target due to the effect of acceleration $a_n^T$ from nature (e.g., acceleration due to gravity, centripetal acceleration, Coriolis acceleration) and thrust $a_t^T$ is given by $$\ddot{p}^T = a_n^T + a_t^T \tag{1}$$

Let the displacement of the target from its initial position due to the effect of its thrust be denoted by $p_t^T$ and the corresponding velocity of the target be denoted by $v_t^T$. Integrating (2), one has for the velocity of the target at time $t_k$. This intercept solution is obtained in a non-rotating inertial frame. The displacement vector between interceptor and target at any arbitrary time is given by using a simplification for gravity, and one has an approximate one-step bootstrap solution to begin from. The squared error between the interceptor and the target is used to determine the two components of the unit vector $\hat{u}_1$. The one-step solution involves obtaining the initial time-to-go and thrust vector direction unit vector $\hat{u}_1$. Once the time-to-intercept or time-to-go $t_{go}$ is determined in the one-step solution, the vector $\hat{u}_1$ defining the direction of the interceptor thrust can be determined. Thus, the one-step solution includes determination of the time-to-go $t_{go}$ and of the direction of thrust $\hat{u}_1$. Three unknown quantities: (1) the time t, and (2) two components of the unit vector $\hat{u}_1$ are solved for during the following iterative process to find the unknown solution to be denoted by the 3-tuple $$x \stackrel{def}{=} [\hat{u}_1^1 \quad \hat{u}_1^2 \quad t]'.$$

Thus, the algorithm for solution of the intercept can be summarized as follows:

(a) Obtain the one-step initial $t_{go}$ (b) obtain one-step initial $\hat{u}_1$ (c) iteratively solve $$x \stackrel{def}{=} [\hat{u}_1^1 \quad \hat{u}_1^2 \quad t_{go}]'$$

The solution of the iteration is deemed complete when conditions are met based on the difference between successive computations of $$x \stackrel{def}{=} [\hat{u}_1^1 \quad \hat{u}_1^2 \quad t_{go}]'$$

being arbitrarily small.

BRIEF DESCRIPTION OF THE DRAWING

FIG. 5A represents position, FIG. 5B represents velocity, and FIG. 5*c* represents acceleration;

DESCRIPTION OF THE INVENTION

Figure 1:
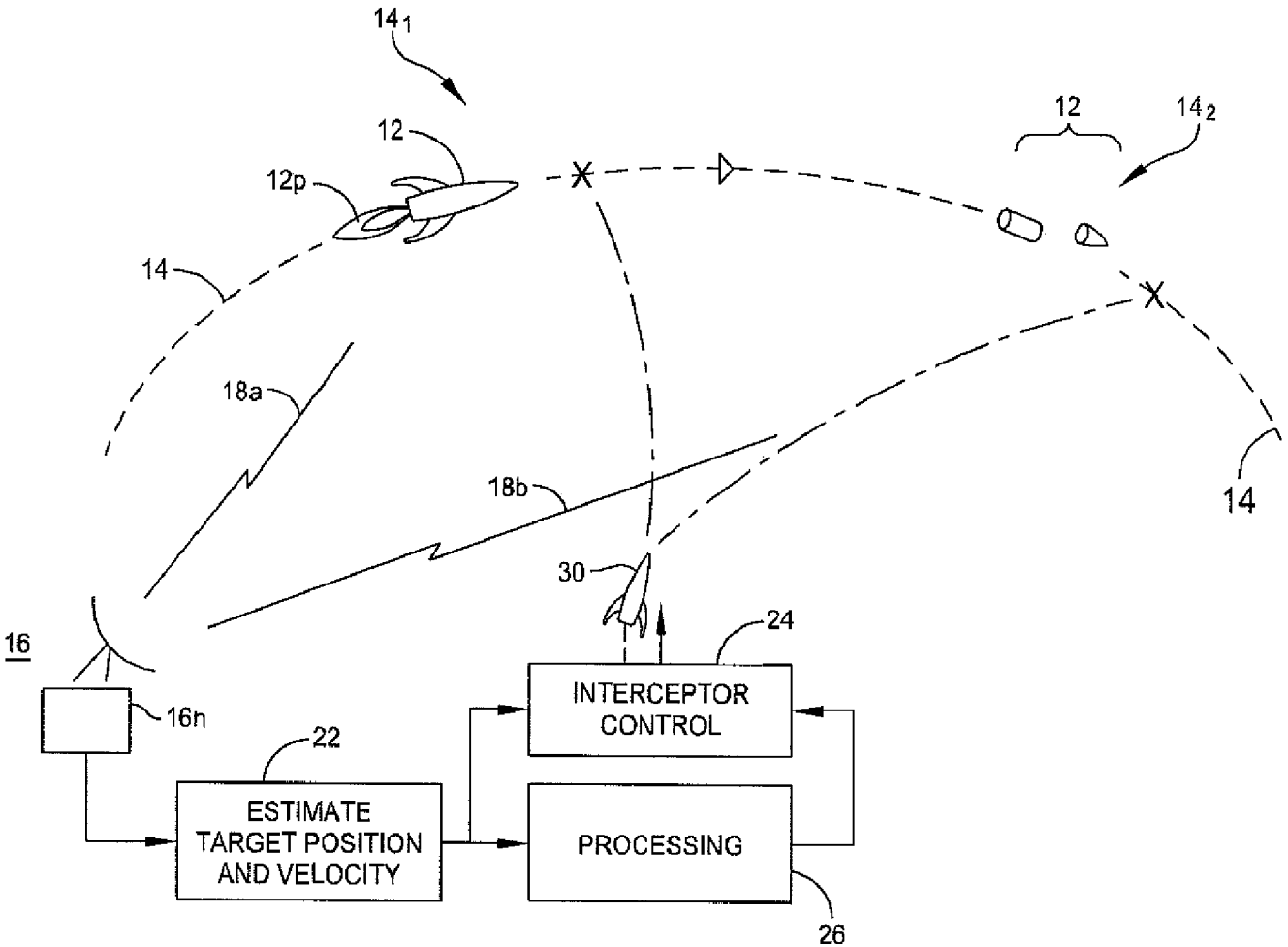
FIG. 1 is a simplified scenario of sensing of information relating to a target missile which may be in a boost phase or a ballistic phase, processing of the sensed information together with information relating to an antimissile or interceptor missile, and guidance control of the interceptor missile.

FIG. 1 illustrates a scenario 10 in which a target missile 12 follows a path or track 14 including an earlier first position $\mathbf{14}_1$ and a second, later, position $\mathbf{14}_2$. Target missile 12 is in a boost phase, suggested by the presence of a plume 12*p* at position $\mathbf{14}_1$, and in a ballistic phase at position $\mathbf{14}_2$, at which position the target missile may split into plural portions, such as decoy and active. Somewhere between locations $14_1$ and $14_2$, the target missile makes a transition between boost phase and ballistic phase. One or more sensors 16, suggested by a radar system 16*r*, produce signals indicative of the moment-to-moment location of the target missile 12. The sensor may be a camera or sensor suite rather than a simple radar system. Radar system (or other sensor) 16 transmits and receives electromagnetic signals, suggested by "lightning bolt" symbols 18*a* and 18*b*, and generates sensed signals representing at least the location of the target missile.

The sensed signals from sensor 16 are applied to processing illustrated as a block 22 in FIG. 1. The processing of block 22 estimates the current target missile position and velocity. The current target missile estimated position and velocity information is applied to an interceptor missile 30 controller, illustrated as a block 24. Controller 24 commands the launching of the interceptor missile 30 generally toward the target missile 12. The current target missile estimated position and velocity information is also applied from estimating block 22 to a processing block 26 according to an aspect of the invention. Processing block 26 generates thrust vector commands for interceptor missile 30, for vectoring the interceptor missile 30 to an intercept with the target missile 12, regardless of the boost or ballistic state of the target missile. The thrust vector commands are made available by way of a path 27 to the interceptor missile control block 24. The thrust vector commands cause the interceptor missile 30 to close with and intercept the target missile.

In general, a guidance system according to an aspect of the invention attempts to generate an exact solution to the intercept point of an interceptor missile with a target missile, based on nonlinear iterative algorithms in which approximations are reduced or eliminated. More particularly, a "one-step" or "bootstrap" solution to the intercept point is generated by determining time-to-go to intercept and the direction of the thrust vector of the interceptor missile, and using this one-step solution as the basis or state vector as a starting point for an iterative solution. The iterative solution generates the commands for the interceptor missile.

Figure 2:
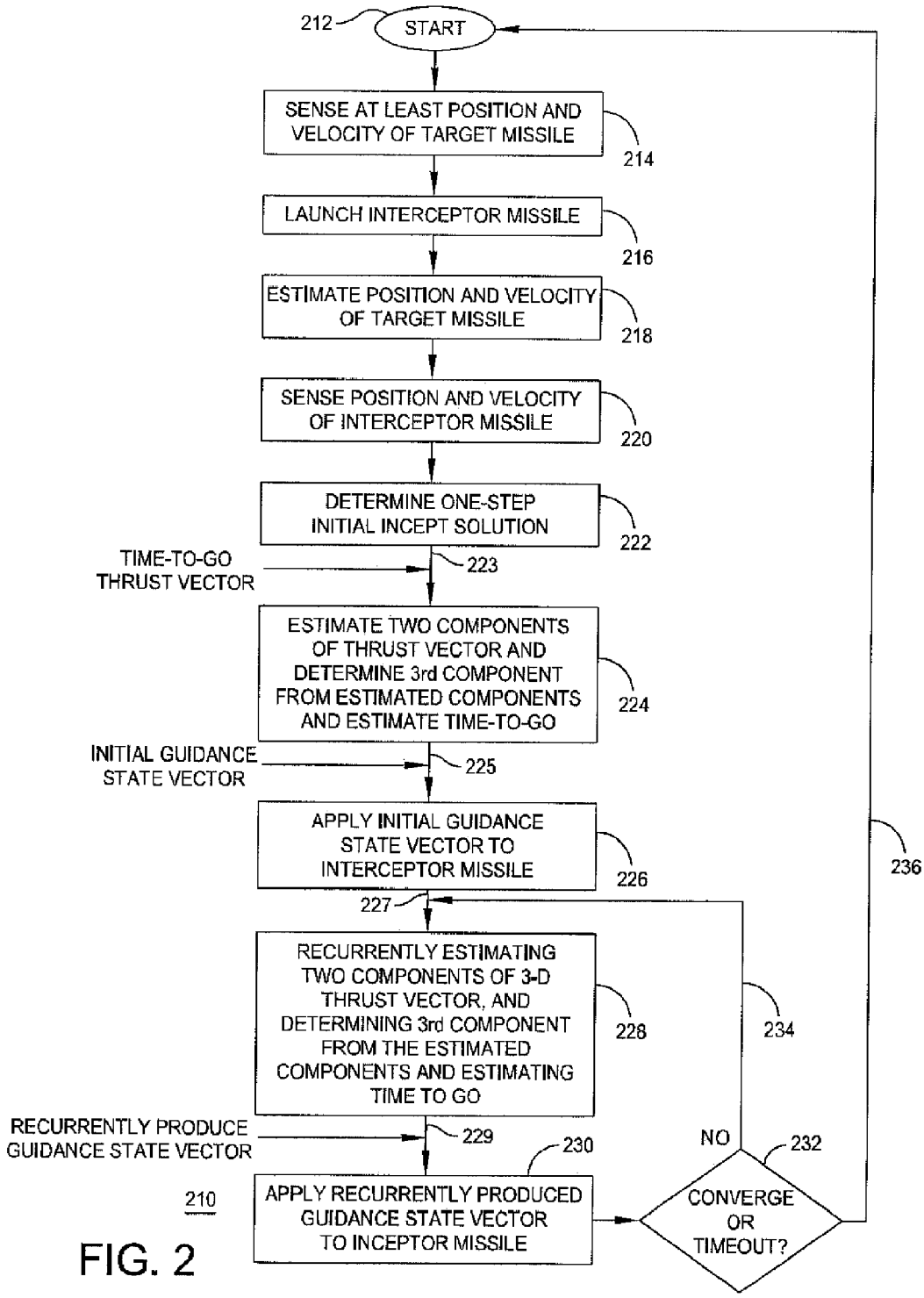
FIG. 2 is a simplified logic flow chart or diagram illustrating processing according to an aspect of the invention.
Figure 3:
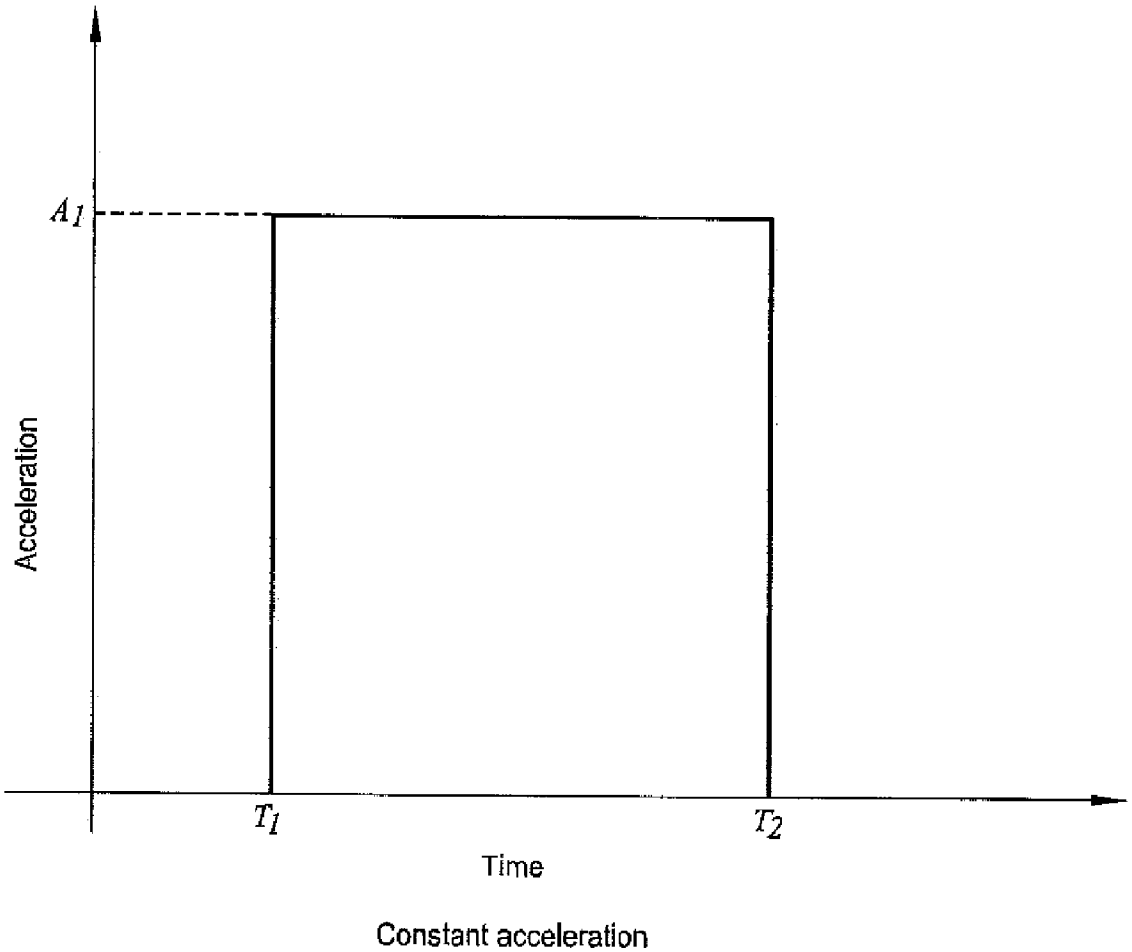
FIG. 3 is a constant target acceleration profile.
Figure 4:
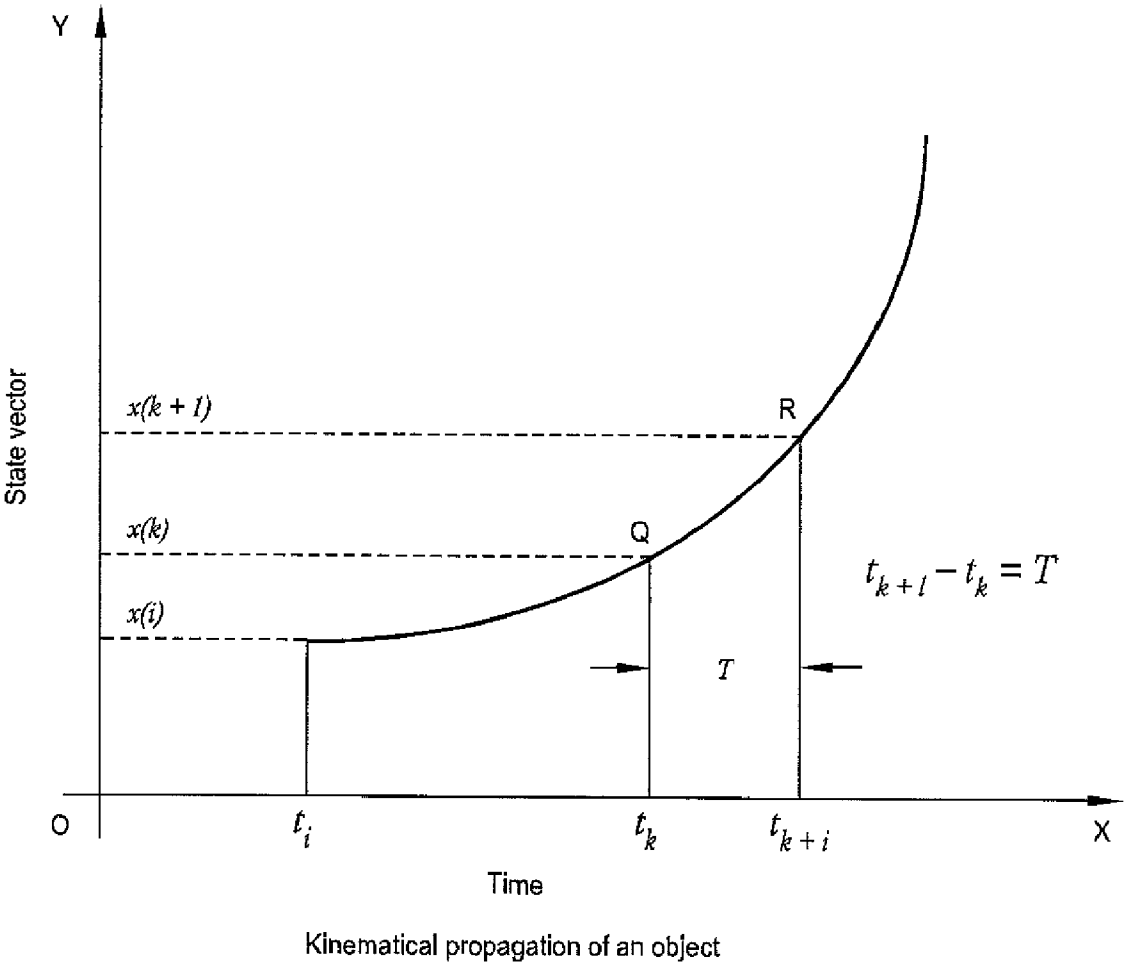
FIG. 4 is a depiction of the kinematical propagation of a target object.
Figures 5A, 5B, 5C:
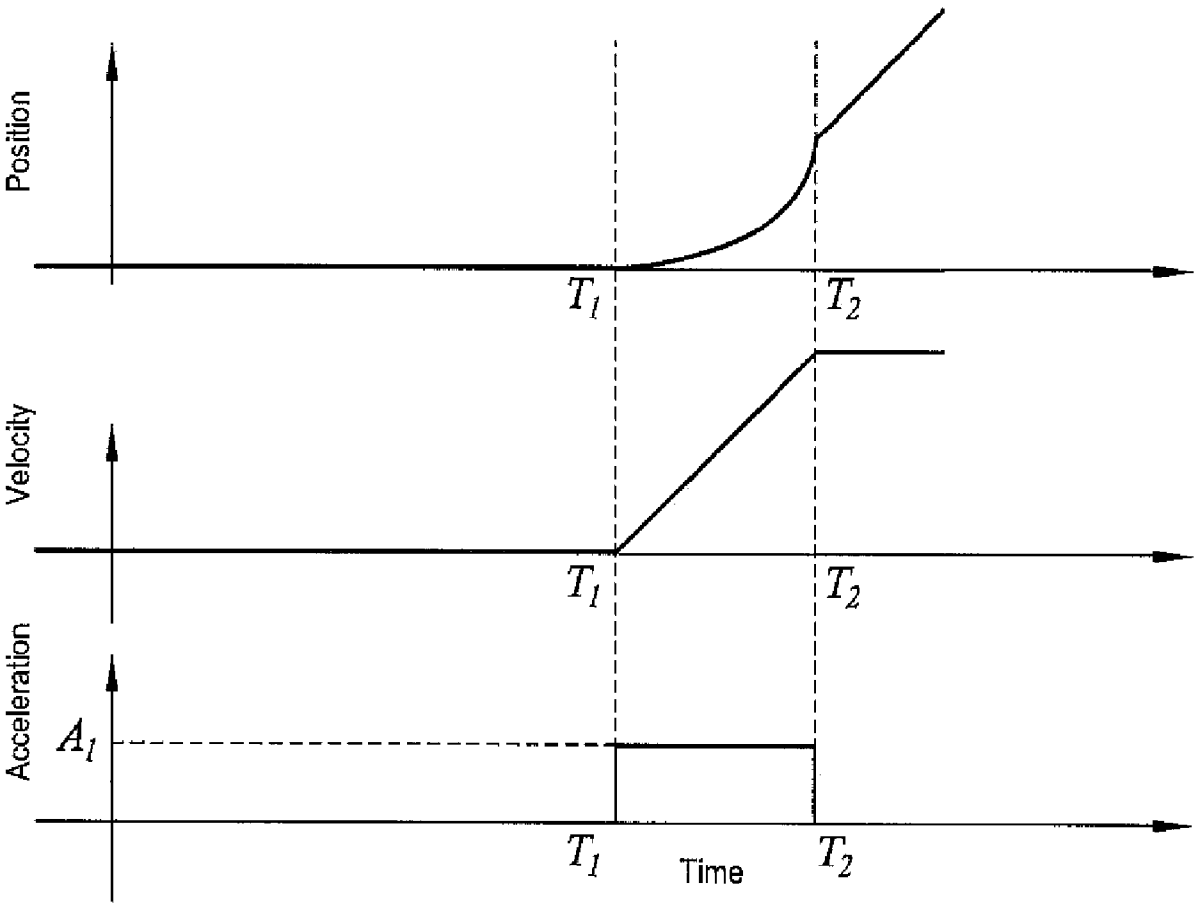
FIGS. 5A, 5B, and 5C together represent the kinematic components of an accelerating target object.
Figure 6:
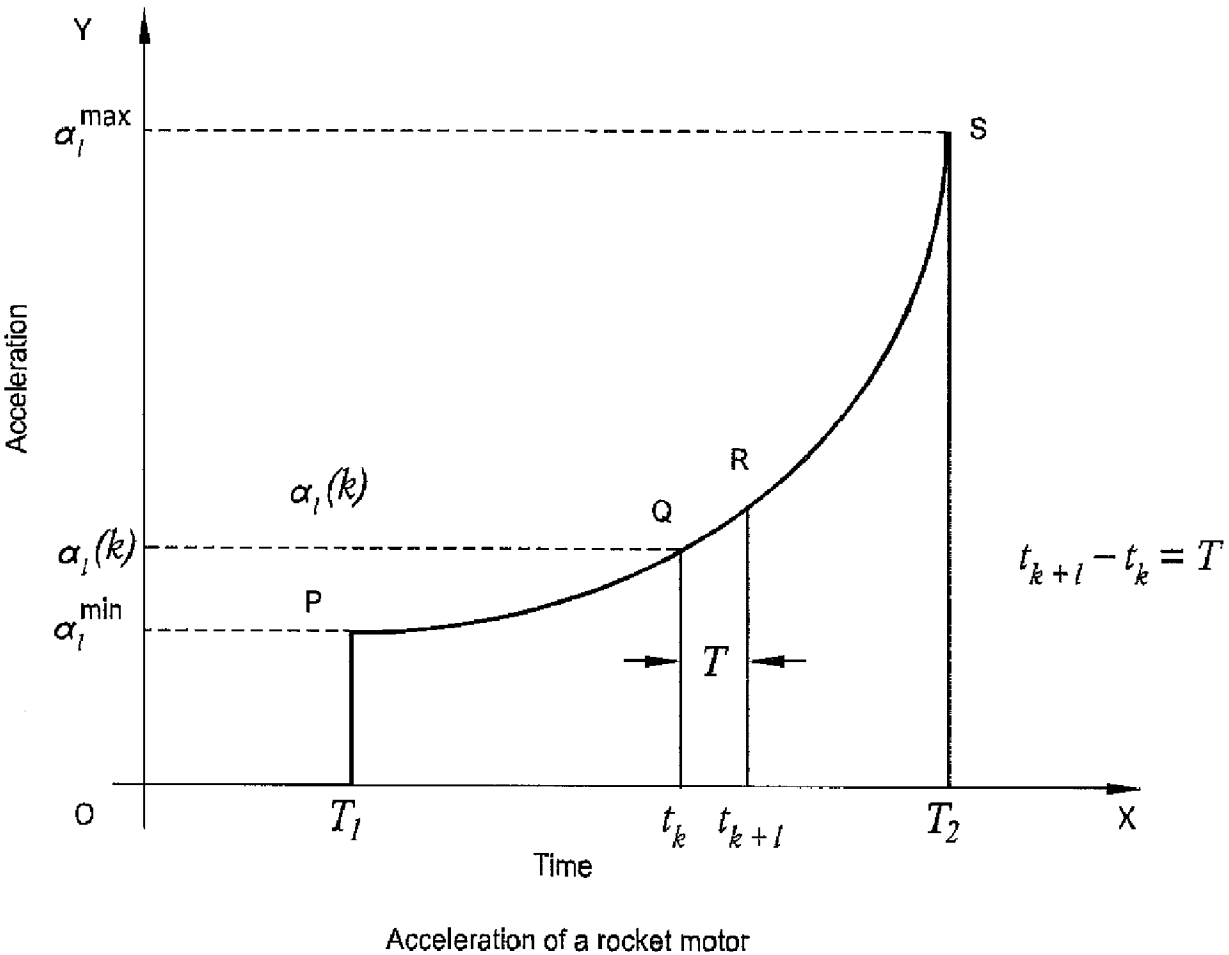
FIG. 6 is an acceleration profile of a rocket motor based upon a rocket equation.
Figure 7:
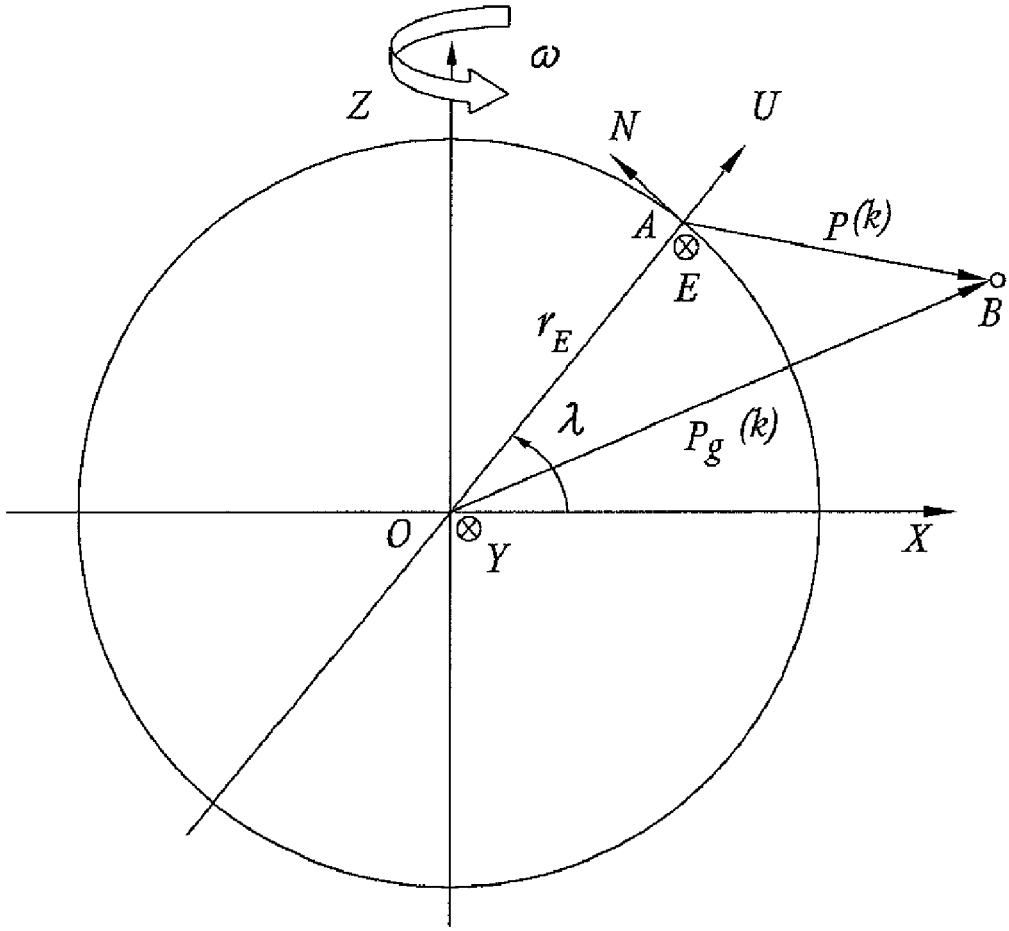
FIG. 7 is a gravity model for space-borne object near a spherical rotating earth with varying gravity.

FIG. 2 illustrates a simplified logic flow chart or diagram illustrating processing 210 according to an aspect of the invention. The processing may be performed by computers associated with the sensor or radar 16 of FIG. 1, with processing blocks 22, 24, or 26, or possibly in computers associated with interceptor missile 30, or the processing may be distributed among a plurality of processors, wherever located. The processing or logic 210 of FIG. 2 starts at a START block 212, and flows to a block 214. Block 214 represents the sensing of information about the target missile (12 of FIG. 1), as might be performed by sensor 16. Block 214 represents the sensing of information about at least the moment-to-moment position of the target missile, from which the target missile velocity can be determined. Alternatively, the target missile velocity can be directly sensed, as by use of Doppler information. The interceptor missile is launched in a direction at least nominally toward the missile, as suggested by block 216. From block 216, the logic of FIG. 2 proceeds to a block 218, which represents the estimation of the position and velocity of the target missile from the sensed information. Block 220 represents the sensing of the position and velocity of the interceptor missile. From block 220, the logic of FIG. 2 flows to a block 222, which represents the determination of a one-step initial intercept (bootstrap) solution, including time-to-go (to intercept) and the three-dimensional interceptor missile thrust vector associated, with the time-to-go.

The logic of one-step initial intercept solution block 222 is aided by the following analysis. Let the initial position and velocity at time $t_0$ of a target T, such as a missile, be denoted by $p^T(0)$, $v^T(0)$ respectively. The motion of the target due to the effect of acceleration $a_n^T$ from nature (e.g., acceleration due to gravity, centripetal acceleration, Coriolis acceleration) and thrust $a_t^T$ is given by $$\ddot{p}^T = a_n^T + a_t^T \tag{2}$$

Let the displacement of the target from its initial position due to the effect of its thrust be denoted by $p_t^T$ and the corresponding velocity of the target be denoted by $v_t^T$. Integrating (2), one has for the velocity of the target at time $t_k$ $$v^T(t_k) = \int_0^{t_k} a_n^T(\tau)\,d\tau + v^T(0) + v_t^T + \Omega \times p_g^T \tag{3}$$

This intercept solution is obtained in a non-rotating inertial frame. Consequently, the terms $\Omega \times p_g^T$ and $\Omega \times p_g^M$ are included in the solution, where $\Omega$ is angular velocity relative to an inertial frame, $p_g^T$ is position of the target missile due to gravity, and $p_g^T$ is position of the interceptor missile due to gravity. Integrating equation (3), one has for the position of the target at time $t_k$ $$p^T(t_k) = \int_0^{t_k}\left(\int_0^{t_k} a_n^T(\tau)\,d\tau\right)dt + [v^T(0) + \Omega \times p_g^T]t_k + p^T(0) + p_t^T \tag{4}$$

Let the initial position and velocity at time $t_0$ of the interceptor be denoted by $p^M(0)$, $v^M(0)$ respectively. The motion of the interceptor due to the effect of acceleration $a_n^M$ from nature (e.g., acceleration due to gravity, centripetal acceleration, Coriolis acceleration) and thrust $a_t^M$ is given by $$\ddot{p}^M + a_n^M + a_t^M \tag{5}$$

Let the displacement of the interceptor from its initial position due to the effect of its thrust be denoted by $p_t^M$ and the velocity of the interceptor due to the effect of its thrust be denoted by $v_t^M$. Integrating (5), one has for the velocity of the interceptor $$v^M(t) = \begin{cases} \int_0^t a_n^M(\tau)\,d\tau + v^M(0) + \Omega \times p_g^M & \text{if } t \le T_1 \\ \int_0^t a_n^M(\tau)\,d\tau + v^M(0) + v_t^M \hat{u}_1 + \Omega \times p_g^M & \text{if } t > T_2 \end{cases} \tag{6}$$

where $\hat{u}_1$ is the direction of the thrust. Integrating (6), one has for the position of the interceptor at time t $$p^M(t) = \begin{cases} \int_0^t\left(\int_0^t a_n^M(\tau)\,d\tau\right)dt + [v^M(0) + \Omega \times p_g^M]t + p^M(0) & \text{if } t \le T_1 \\ \int_0^t\left(\int_0^t a_n^M(\tau)\,d\tau\right)dt + [v^M(0) + \Omega \times p_g^M]t + p^M(0) + \{p_t^M + v_t^M(t - T_2)\}\hat{u}_1 & \text{if } t > T_2 \end{cases} \tag{7}$$

The displacement vector $\epsilon^{MT}(t)$ between interceptor and target at any arbitrary time $t>T_2$ is given by $$\varepsilon^{MT}(t) = \int_0^t\left(\int_0^\tau a_n^M(\tau)d\tau\right)dt + [v^M(0) + \Omega\times p_g^M]t + p^M(0) + \{p_t^M + v_t^M(t-T_2)\}\hat{u}_1 - \int_0^t\left(\int_0^\tau a_n^T(\tau)d\tau\right)dt - [v^T(0) + \Omega\times p_g^T]t - p^T(0) - p_t^T = [\{p^M(0) - p^T(0)\} + \{p_t^M - v_t^M T_2\}\hat{u}_1 - p_t^T] + \{v^M(0) + \Omega\times p_g^M - v^T(0) - \Omega\times p_g^T + v_t^M\hat{u}_1\}t + \int_0^t\left(\int_0^\tau a_n^M(\tau)d\tau\right)dt - \int_0^t\left(\int_0^\tau a_n^T(\tau)d\tau\right)dt \tag{8}$$

Using a simplification for gravity, one has $$\int_0^t\left(\int_0^\tau a_n^M(\tau)d\tau\right)dt - \int_0^t\left(\int_0^\tau a_n^T(\tau)d\tau\right)dt = \frac{1}{3}\Delta g(0)t^2 \tag{9}$$

Defining $$A \stackrel{def}{=} \frac{1}{3}\Delta g(0) \tag{10}$$

$$B \stackrel{def}{=} \{v^M(0) + \Omega\times p_g^M - v^T(0) - \Omega\times p_g^T + v_t^M\hat{u}_1\} \tag{11}$$

$$C \stackrel{def}{=} [\{p^M(0) - p^T(0)\} + \{p_t^M - v_t^M T_2\}\hat{u}_1 - p_t^T] \tag{12}$$

equation (8) can be rewritten as $$\epsilon^{MT}(t)=C+Bt+At^2 \tag{13}$$

The squared error J between the interceptor and the target is given by $$J=[\epsilon^{MT}(t)]'[\epsilon^{MT}(t)]=[C+Bt+At^2]'[C+Bt+At^2] \tag{14}$$

where the primes associated with the matrices represent the transpose. Note that J in equation (14) is a scalar function of three unknown quantities. These are: (1) the time t, and (2) two components of the unit vector $\hat{u}_1$ in the direction of thrust of the interceptor. Note that the third component of a unit vector $\hat{u}_1$ is known if two of its components are known. A simultaneous nonlinear solution for these quantities is desired for block 222 of FIG. 2.

An approximate one-step bootstrap solution is sought for this nonlinear solution to begin from. The squared error J between the interceptor and the target in equation (14) is more dependent on the time t than on the two components of the unit vector $\hat{u}_1$. Consider a preliminary unit vector $\hat{u}_1$ defining a direction. The one-step solution involves obtaining the time t that minimizes squared error J, and subsequently using this value of t to solve for $\hat{u}_1$. The minimization of time t is formulated as $$t_{go} = \arg\min_t[C + Bt + At^2]'[C + Bt + At^2] \tag{15}$$

Minimizing J in (14) with respect to time t $$\frac{\partial J}{\partial t} = 2(\varepsilon^{MT})'\left(\frac{\partial\varepsilon^{MT}}{\partial t}\right) = 2[C + Bt + At^2]'[B + 2At] = 2[C'B + (B'B + 2C'A)t + (A'B + 2B'A)t^2 + 2A'At^3] \tag{16}$$

Note that the term A (from equation 9) is usually small. Therefore, one can neglect the $A'At^3$ term, and solve (16) as a quadratic as follows $$C'B+(B'B+2C'A)t+(A'B+2B'A)t^2=0 \tag{17}$$

or $$a\bar{t}^2+b\bar{t}+c=0 \tag{18}$$

where $$a=C'B \tag{19}$$

$$b=B'B+2C'A \tag{20}$$

$$c=A'B+2B'A \tag{21}$$

$$\bar{t} = \frac{1}{t} \tag{22}$$

Note that, if A is small, the term c is also small. This formulation, if A is small, avoids any difficulty of the quadratic solution.

Solving equation (18) yields $$\bar{t} = \frac{-b \pm \sqrt{b^2 - 4ac}}{2a} \tag{23}$$

and $$t = \frac{1}{\bar{t}} \tag{24}$$

time-to-go $t_{go}$ is deemed to be equal to the value of t determined in equation (23).

This first part of the one-step solution of block 222 of FIG. 2 can alternately be expressed as determining time-to-go by $$t_{go} = \frac{1}{\bar{t}} \tag{23A}$$

where:

$$\bar{t} = \frac{-b \pm \sqrt{b^2 - 4ac}}{2a} \tag{22}$$

where:

$$a = C'B \tag{18}$$

$$b = B'B + 2C'A \tag{19}$$

$$c = A'B + 2B'A \tag{20}$$

where:

$$A \overset{def}{=} \frac{1}{3}\Delta g(0) \tag{9}$$

$$B \overset{def}{=} \{v^M(0) + \Omega \times p_g^M - v^T(0) - \Omega \times p_g^T + v_t^M \hat{u}_1\} \tag{10}$$

$$C \overset{def}{=} [\{p^M(0) - p^T(0)\} + \{p_t^M - v_t^M T_2\}\hat{u}_1 - P_t^T] \tag{11}$$

and:

$\Delta g(0)$ is the differential gravity between the missile and the interceptor at time $t_0$;

$v^M(0)$ is the velocity of the interceptor or countermeasure missile at time $t_0$;

$\Omega$ is angular velocity relative to an inertial frame;

$p_g^M$ is position of the interceptor missile due to gravity;

$v^T(0)$ is the initial velocity of the target missile at time $t_0$;

$p_g^T$ is position of the target missile due to gravity;

$\hat{u}_1$ is a unit vector in the direction of interceptor thrust;

$p^M(0)$ is the initial position of the interceptor at time $t_0$;

$p^T(0)$ is the initial position of the target missile at time $t_0$;

$p_t^M$ is the displacement of the interceptor missile due to the effect of its thrust;

$v_t^M$ is the velocity of the interceptor due to the effect of its thrust;

$T_2$ is the end of acceleration of the interceptor missile; and $p_t^T$ is displacement of the target missile due to its thrust.

As mentioned, once the time to intercept or time-to-go $t_{go}$ is determined in the one-step solution performed in block 222 of FIG. 2, the vector $\hat{u}_1$ defining the direction of the interceptor thrust can be determined. Thus, the one-step solution of block 222 includes determination of the time-to-go $t_{go}$ and of the direction of thrust $\hat{u}_1$. Observe from equation (13) that $C'B<0$, $C'A<0$, $A'B>0$ for $\Delta_{MT}(t)$ to decrease. Thus in equation (23), $a<0$, $b>0$, $c>0$. For real solutions, $b^2-4ac>0$. Also, one should choose the negative sign of the radical so that $\bar{t}$ takes the largest value and t is the least value. Having obtained one returns to equation (13), in which the displacement vector $\epsilon^{MT}(t)$ between the interceptor missile and the target missile can be rewritten as $$\varepsilon^{MT}(t) = [\{p^M(0) - p^T(0)\} + \{p_t^M - v_t^M T_2\}\hat{u}_1 - p_t^T] + \tag{25}$$

-continued $$\{v^M(0) - v^T(0) + v_t^M \hat{u}_1\}t + \frac{1}{3}\Delta g(0)t^2$$

$$= [\{p_t^M - v_t^M T_2\} + v_t^M t]\hat{u}_1 + \{p^M(0) - p^T(0)\} + \{v^M(0) - v^T(0)\}t - p_t^T + \frac{1}{3}\Delta g(0)t^2$$

Note that (25) is a three dimensional vector equation; however, the coefficient of $\hat{u}_1$ is a scalar quantity. Solving equation (25) for zero yields $$\hat{u}_1 = -\frac{\{p^M(0) - p^T(0)\} - p_t^T + \{v^M(0) - v^T(0)\}t + \frac{1}{3}\Delta g(0)t^2}{[\{p_t^M - v_t^M T_2\} + v_t^M t]} = -\frac{\{p^M(0) - p^T(0)\} - p_t^T + \{v^M(0) - v^T(0)\}t + \frac{1}{3}\Delta g(0)t^2}{[p_t^M + v_t^M(t - T_2)]} \tag{26}$$

The time-to-go, defined as $t_{go}$, is set equal to the solution of t obtained in equation (24).

Equations (23) and (25) of the one-step initial intercept solution are solved in block 222 of FIG. 2. The information flowing from logic block 222 includes initial time-to-go $t_{go}$ and the direction of the initial interceptor thrust vector. From block 222, the logic of FIG. 2 flows by a path 223 to a block 224. Block 224 represents an iterative estimation of time-to-go and of two components of the thrust vector, and determination of the third component from the estimated components. The two thrust vector components that are estimated are preferably the two smallest.

The displacement vector $\epsilon^{MT}(t, \hat{u}_1)$ between interceptor and target at any arbitrary time $t>T_2$ is restated as $$\varepsilon^{MT}(t, \hat{u}_1) = [\{p^M(0) - p^T(0)\} + \{p_t^M - v_t^M T_2\}\hat{u}_1 - p_t^T] + \{v^M(0) - v^T(0) + v_t^M \hat{u}_1\}t + \frac{1}{3}\Delta g(0)t^2 \tag{27}$$

The displacement vector $\epsilon^{MT}(t, \hat{u}_1)$ in equation (27) is a nonlinear vector function of three unknown quantities. These three unknown quantities are: (1) the time t, and (2) two components of the unit vector $\hat{u}_1$. Consider the unknown solution to be denoted by the 3-tuple $$x \overset{def}{=} [\hat{u}_1^1 \quad \hat{u}_1^2 \quad t]'.$$

A simultaneous nonlinear solution for $\epsilon^{MT}(x)=0$ is possible. The solution of x for $\epsilon^{MT}(x)=0$ is obtained by Newton-Raphson's formula as $$x(k+1) = x(k) - \Delta x(k) \tag{28}$$

$$\Delta x(k) = \left[\frac{\partial \varepsilon^{MT}(x)}{\partial x}\right]^{-1}\Bigg|_{x=x(k)} \varepsilon^{MT}(x)\Bigg|_{x=x(k)} = \left[\frac{\partial \varepsilon^{MT}(x)}{\partial \hat{u}_1^1} \frac{\partial \varepsilon^{MT}(x)}{\partial \hat{u}_1^2} \frac{\partial \varepsilon^{MT}(x)}{\partial t}\right]^{-1} \begin{bmatrix} \varepsilon_1^{MT}(x) \\ \varepsilon_2^{MT}(x) \\ \varepsilon_3^{MT}(x) \end{bmatrix} \tag{29}$$

-continued $$= \begin{bmatrix} \frac{\partial \varepsilon_1^{MT}(x)}{\partial \hat{u}_1^1} & \frac{\partial \varepsilon_1^{MT}(x)}{\partial \hat{u}_1^2} & \frac{\partial \varepsilon_1^{MT}(x)}{\partial t} \\ \frac{\partial \varepsilon_2^{MT}(x)}{\partial \hat{u}_1^1} & \frac{\partial \varepsilon_2^{MT}(x)}{\partial \hat{u}_1^2} & \frac{\partial \varepsilon_2^{MT}(x)}{\partial t} \\ \frac{\partial \varepsilon_3^{MT}(x)}{\partial \hat{u}_1^1} & \frac{\partial \varepsilon_3^{MT}(x)}{\partial \hat{u}_1^2} & \frac{\partial \varepsilon_3^{MT}(x)}{\partial t} \end{bmatrix}^{-1} \begin{bmatrix} \varepsilon_1^{MT}(x) \\ \varepsilon_2^{MT}(x) \\ \varepsilon_3^{MT}(x) \end{bmatrix}$$

is evaluated at x=x(k). The expression for the first column $$\frac{\delta \varepsilon^{MT}(x)}{\delta \hat{\mu}_1^1}$$

is $$\frac{\partial \varepsilon^{MT}(x)}{\partial \hat{u}_1^1} = \{p_t^M - v_t^M T_2 + v_t^M t\} \begin{bmatrix} 0 \\ 1 \\ -\frac{u_1}{\sqrt{1-u_1^2-u_2^2}} \end{bmatrix} \tag{30}$$

and the expression for the second column $$\frac{\delta \varepsilon^{MT}(x)}{\delta \hat{\mu}_1^2}$$

is $$\frac{\partial \varepsilon^{MT}(x)}{\partial \hat{u}_1^2} = \{p_t^M - v_t^M T_2 + v_t^M t\} \begin{bmatrix} 0 \\ 1 \\ -\frac{u_2}{\sqrt{1-u_1^2-u_2^2}} \end{bmatrix} \tag{31}$$

Equations (30) and (31) can be combined as $$\left[\frac{\partial \varepsilon^{MT}(x)}{\partial \hat{u}_1^1} \; \frac{\partial \varepsilon^{MT}(x)}{\partial \hat{u}_1^2}\right] = \tag{32}$$

$$\{p_t^M - v_t^M T_2 + v_t^M t\} \begin{bmatrix} 1 & 0 \\ 0 & 1 \\ -\frac{u_1}{\sqrt{1-u_1^2-u_2^2}} & -\frac{u_2}{\sqrt{1-u_1^2-u_2^2}} \end{bmatrix}$$

The expression for the third column $$\frac{\delta \varepsilon^{MT}(x)}{\delta t}$$

is $$\frac{\partial \varepsilon^{MT}(x)}{\partial t} = \{v^M(0) - v^T(0) + v_t^M \hat{u}_1\} + \frac{2}{3}\Delta g(0)t \tag{32}$$

Thus, the algorithm for solution of the one-step initial intercept, performed in blocks 222 and 224 of FIG. 2, can be summarized as follows:

(a) Obtain the one-step initial $t_{go}$ using equations (10), (11, (12), (18), (19), (20), (22), and (23);

(b) obtain one-step initial $\hat{u}_1$ using equation (26); and (c) iteratively solve $$x \stackrel{def}{=} [\hat{u}_1^1 \;\; \hat{u}_1^2 \;\; t_{go}]'$$

using equations (28) until the condition for loop termination conditions are met. These conditions may be based on the difference between successive computations of $$x \stackrel{def}{=} [\hat{u}_1^1 \;\; \hat{u}_1^2 \;\; t_{go}]'$$

becoming arbitrarily small. This produces on logic path 225 of FIG. 2 the initial state guidance for the interceptor missile 30 of FIG. 1.

Block 226 of FIG. 2 receives the initial state guidance from block 224, and represents application of the initial state guidance to the interceptor missile 30 of FIG. 1. The initial state guidance commands of the interceptor missile are followed by additional guidance commands. From logic block 226 of FIG. 2, the logic flows to a block 228, which represents the recurrent estimation of two components of the thrust vector, and determination of the third component from the two estimated components, and estimation of time-to-go. The recurrently-generated guidance state vectors are produced on a logic path 229. Block 230 represents the application of the recurrently-produced guidance state vector to the interceptor missile.

From block 230 of FIG. 2, the logic flows to a decision block 232, which determines if the logic has converged on a solution. If the logic has not converged, the logic leaves decision block 232 by the NO path and returns to path 227 and the input of block 228 to perform another estimation of the two components of the thrust vector, and determination of the third component, and the estimation of time-to-go. The iteration around the loop including blocks 228, 230, and 232 continues until decision block 232 determines that convergence on a solution has occurred, whereupon the logic leaves decision block 232 by the YES output and either returns by a path 236 to the START block 212 in readiness for control of another interceptor missile, or ends (not illustrated).

What is claimed is:

1. A method for thrust vector control of an interceptor against a target missile, said method comprising the steps of:

sensing at least position and velocity of said target missile to thereby generate a stream of sensed target signals;

processing said stream of sensed target signals to produce estimates of at least position and velocity of said target missile;

launching an interceptor missile toward an estimated intercept position of said target missile;

generating signals representing at least position and velocity of said interceptor missile;

determining a one-step initial intercept solution based upon (a) said estimates of at least position of said target missile and (b) at least the position of said interceptor missile, to produce information including time-to-go and current direction of a thrust vector of said interceptor missile;

using time-to-go and direction of the thrust vector from the one-step intercept solution, initially estimating at least two components of a three-dimensional unit thrust vector, and determining a third component of said three-dimensional unit thrust vector from said estimated components, and estimating the time-to-go, to thereby produce an initial guidance state vector for closing the interceptor missile with said target missile;

applying said initial guidance state vector to said interceptor missile for initial thrust vectoring;

recurrently estimating at least two components of the three-dimensional unit thrust vector, and determining a third component from said estimated components, and also estimating the time-to-go, until a steady-state solution is found or a time-out occurs, to thereby recurrently produce the guidance state vector;

applying said recurrently produced guidance state vector to said interceptor missile for guidance thereof; and repeating said steps of recurrently estimating and applying.

2. A method according to claim 1, wherein said step of estimating at least two components of the three-dimensional unit thrust vector includes the step of estimating the two smallest components of the first, second and third components of the three-dimensional unit thrust vector.

3. A method according to claim 1, wherein steps of determining the one-step initial intercept solution comprises the steps of:

determining an initial estimate of time to go to intercept $$t_{go} = \frac{1}{\bar{t}}$$

where:

$$\bar{t} = \frac{-b \pm \sqrt{b^2 - 4ac}}{2a}$$

where:

$$a = C'B$$

$$b = B'B + 2C'A$$

$$c = A'B + 2B'A$$

where:

$$A \stackrel{def}{=} \frac{1}{3}\Delta g(0)$$

$$B \stackrel{def}{=} \{v^M(0) + \Omega \times p_g^M - v^T(0) - \Omega \times p_g^T + v_t^M \hat{u}_1\}$$

$$C \stackrel{def}{=} [\{p^M(0) - p^T(0)\} + \{p_t^M - v_t^M T_2\}\hat{u}_1 - p_t^T]$$

and:

$\Delta g(0)$ is the differential gravity between the missile and the interceptor at time 0;

$v^M(0)$ is the velocity of the interceptor or countermeasure missile at time 0;

$\Omega$ is the angular velocity relative to an inertial frame;

$p_g^M$ is the position of the interceptor missile due to gravity;

$v^T(0)$ is the initial velocity of the target missile at time $t_0$;

$p_g^T$ is position of the target missile due to gravity;

$\hat{u}_1$ is a unit vector in the direction of the interceptor thrust;

$p^M(0)$ is the initial position of the interceptor at time $t_0$;

$p^T(0)$ is the initial position of the target missile at time $t_0$;

$p_t^M$ is the displacement of the interceptor missile due to the effect of its thrust;

$v_t^M$ is the velocity of the interceptor due to the effect of its thrust;

$T_2$ is the end of acceleration of the interceptor missile; and $p_t^T$ is the displacement of the target missile due to its thrust.

4. A method according to claim 3, wherein said step of determining the one-step initial intercept solution further comprises the steps of:

determining current direction of the thrust vector $\hat{u}_1$ of said interceptor missile by $$\hat{u}_1 = -\frac{\{p^M(0) - p^T(0)\} - p_t^T + \{v^M(0) - v^T(0)\}t + \frac{1}{3}\Delta g(0)t^2}{[\{p_t^M + v_t^M T_2\} + v_t^M t]}$$

$$= -\frac{\{p^M(0) - p^T(0)\} - p_t^T + \{v^M(0) - v^T(0)\}t + \frac{1}{3}\Delta g(0)t^2}{[p_t^M + v_t^M(t - T_2)]}.$$

5. A method according to claim 1, further comprising the steps of:

using time-to-go and direction of the thrust vector from the one-step intercept solution, initially estimating at least two components of the three-dimensional unit thrust vector, and determining the third component of said three-dimensional unit thrust vector from said estimated components, and estimating the time-to-go, to produce the guidance state vector for closing the interceptor missile with said target missile.

6. A method according to claim 1, further comprising the steps of:

applying said initial guidance state vector to said interceptor missile for initial thrust vectoring;

recurrently estimating at least two components of the three-dimensional unit thrust vector, and determining the third component from said estimated components, and estimating the time-to-go until a steady-state solution is found or a time-out occurs, to recurrently produce the guidance state vector;

applying said recurrently produced guidance state vector to said interceptor missile; and repeating said steps of recurrently estimating and applying.

7. A method according to claim 6, further comprising the steps of:

iteratively updating the three unknown components for guidance: (1) the time-to-go t, and (2) two components of the unit vector[1] $\hat{u}_1$, considering the unknown solution be denoted by the 3-tuple $$x \stackrel{def}{=} [\,\hat{u}_1^1 \quad \hat{u}_1^2 \quad t\,]$$

and the solution of 3-tuplex x is obtained by a non-linear equation solver such as Newton-Raphson's formula where for $\epsilon^{MT}(x)=0$ where $$\varepsilon^{MT}(t, \hat{u}_1) = [\{p^M(0) - p^T(0)\} + \{p_t^M - v_t^M T_2\}\hat{u}_1 - p_t^T] + \{v^M(0) = v^T(0) + v_t^M \hat{u}_1\}t + \frac{1}{3}\Delta g(0)t^2$$

and the solution of x is recursively solved for using $$x(k+1)=x(k)-\Delta x(k)$$

where $$\Delta x(k) = \left[\frac{\partial \varepsilon^{MT}(x)}{\partial x}\right]^{-1}\Big|_{x=x(k)}\varepsilon^{MT}(x)\Big|_{x=x(k)}$$

$$= \begin{bmatrix} \frac{\partial \varepsilon^{MT}(x)}{\partial \hat{u}_1^1} & \frac{\partial \varepsilon^{MT}(x)}{\partial \hat{u}_1^2} & \frac{\partial \varepsilon^{MT}(x)}{\partial t} \end{bmatrix}^{-1} \begin{bmatrix} \varepsilon_1^{MT}(x) \\ \varepsilon_2^{MT}(x) \\ \varepsilon_3^{MT}(x) \end{bmatrix}$$

$$= \begin{bmatrix} \frac{\partial \varepsilon_1^{MT}(x)}{\partial \hat{u}_1^1} & \frac{\partial \varepsilon_1^{MT}(x)}{\partial \hat{u}_1^2} & \frac{\partial \varepsilon_1^{MT}(x)}{\partial t} \\ \frac{\partial \varepsilon_2^{MT}(x)}{\partial \hat{u}_1^1} & \frac{\partial \varepsilon_2^{MT}(x)}{\partial \hat{u}_1^2} & \frac{\partial \varepsilon_2^{MT}(x)}{\partial t} \\ \frac{\partial \varepsilon_3^{MT}(x)}{\partial \hat{u}_1^1} & \frac{\partial \varepsilon_3^{MT}(x)}{\partial \hat{u}_1^2} & \frac{\partial \varepsilon_3^{MT}(x)}{\partial t} \end{bmatrix}^{-1} \begin{bmatrix} \varepsilon_1^{MT}(x) \\ \varepsilon_2^{MT}(x) \\ \varepsilon_3^{MT}(x) \end{bmatrix}$$

where the expression for the first column $$\frac{\delta \varepsilon^{MT}(x)}{\delta \hat{u}_1^1}$$

is $$\frac{\partial \varepsilon^{MT}(x)}{\partial \hat{u}_1^1} = \{p_t^M - v_t^M T_2 + v_t^M t\}\begin{bmatrix} 1 \\ 0 \\ u_1 \\ -\frac{}{\sqrt{1-u_1^2-u_2^2}} \end{bmatrix}$$

and the expression for the second column $$\frac{\delta \varepsilon^{MT}(x)}{\delta \hat{u}_1^2}$$

is $$\frac{\partial \varepsilon^{MT}(x)}{\partial \hat{u}_1^2} = \{p_t^M - v_t^M T_2 + v_t^M t\}\begin{bmatrix} 0 \\ 1 \\ u_2 \\ -\frac{}{\sqrt{1-u_1^2-u_2^2}} \end{bmatrix}$$

and where the expression for the first column and the expression for the second column can be combined as $$\begin{bmatrix} \frac{\partial \varepsilon^{MT}(x)}{\partial \hat{u}_1^1} & \frac{\partial \varepsilon^{MT}(x)}{\partial \hat{u}_1^2} \end{bmatrix} = \{p_t^M - v_t^M T_2 + v_t^M t\}\begin{bmatrix} 1 & 0 \\ 0 & 1 \\ u_1 & u_2 \\ -\frac{}{\sqrt{1-u_1^2-u_2^2}} & -\frac{}{\sqrt{1-u_1^2-u_2^2}} \end{bmatrix}$$

with the expression for the third column $$\frac{\delta \varepsilon^{MT}(x)}{\delta t}$$

being $$\frac{\partial \varepsilon^{MT}(x)}{\partial t} = \{v^M(0) - v^T(0) + v_t^M \hat{u}_1\} + \frac{2}{3}\Delta g(0)t.$$

8. A method according to claim 1, wherein said steps of recurrently estimating and applying are repeated until a condition for loop termination is met.

9. A method according to claim 8, wherein said condition for loop termination is a convergence on a solution.

10. A method according to claim 9, wherein said convergence on a solution occurs when a value of a difference between successive computations of a displacement vector between the interceptor and the target is less than a predetermined value.

11. A system for thrust vector control of an interceptor against a target missile, comprising:

an interceptor missile controller; and a processor executing instructions to perform the following steps:

receiving a stream of sensed target signals representing position and velocity of said target missile;

processing said stream of sensed target signals to produce estimates of position and velocity of said target missile;

generating a signal that includes a command that causes the interceptor missile controller to launch an interceptor missile toward an estimated intercept position of said target missile;

generating signals representing position and velocity of said interceptor missile;

determining a one-step initial intercept solution based on said estimates of position of said target missile and the position of said interceptor missile, to produce information including time-to-go and current direction of a thrust vector of said interceptor missile;

using said time-to-go and said direction of the thrust vector from the one-step intercept solution, initially estimating at least two components of a three-dimensional unit thrust vector, and determining a third component of said three-dimensional unit thrust vector from said estimated components, and estimating the time-to-go, to produce an initial guidance state vector;

applying said initial guidance state vector to said interceptor missile for initial thrust vectoring;

recurrently estimating at least two components of the three-dimensional unit thrust vector, and determining the third component from said estimated components, and estimating the time-to-go, until a steady-state solution is found or a time-out occurs, to recurrently produce the guidance state vector;

applying said recurrently produced guidance state vector to said interceptor missile for guidance thereof; and repeating said steps of recurrently estimating and applying.

12. A system according to claim 11, wherein said step of estimating at least two components of the three-dimensional unit thrust vector includes the step of estimating the two smallest components of the first, second and third components of the three-dimensional unit thrust vector.

13. A system according to claim 11, wherein the processor executes instructions to perform the further steps of:

using time-to-go and direction of the thrust vector from the one-step intercept solution, initially estimating at least two components of the three-dimensional unit thrust vector, and determining the third component of said three-dimensional unit thrust vector from said estimated components, and estimating the time-to-go, to produce the guidance state vector required to close the interceptor missile with said target missile.

14. A system according to claim 11, wherein the processor executes instructions to perform the further steps of:

applying said initial guidance state vector to said interceptor missile for initial thrust vectoring;

recurrently estimating at least two components of the three-dimensional unit thrust vector, and determining the third component from said estimated components, and estimating the time-to-go, until a steady-state solution is found or a time-out occurs, to recurrently produce the guidance state vector;

applying said recurrently produced guidance state vector to said interceptor missile; and repeating said steps of recurrently estimating and applying.

15. A system according to claim 11, wherein the processor is associated with the interceptor missile.

16. A system according to claim 11, wherein the processor comprises a plurality of processors associated with at least one of a sensor, a radar, and the interceptor missile.

17. A system according to claim 11, wherein said steps of recurrently estimating and applying are repeated until a condition for loop termination is met.

18. A system according to claim 17, wherein said condition for loop termination is a convergence on a solution.

19. A system according to claim 18, wherein said convergence on a solution occurs when a value of a difference between successive computations of a displacement vector between the interceptor and the target is less than a predetermined value.

20. A method of controlling a thrust vector of an interceptor missile, the method comprising the steps of:

sensing at least the position and velocity of a target missile;

estimating an intercept position of said target missile and said interceptor missile;

determining a one-step initial intercept solution based on an estimated target missile position and a current interceptor missile position, said one-step initial intercept solution including a time-to-go and a current direction of a unit thrust vector;

estimating two components of a three-dimensional unit thrust vector based on said time-to-go and said current direction of the thrust vector and determining a third component of said three-dimensional unit thrust vector based on the estimated two components to produce an initial guidance vector and applying said initial guidance vector to said interceptor missile;

iteratively estimating said two components and determining said third component of said three-dimensional unit thrust vector to update said initial guidance vector and applying the updated guidance vector to said interceptor missile.

* * * * *